United States Patent [19]

Kodera

[11] 4,173,972

[45] Nov. 13, 1979

[54] MASSAGING MACHINE

[76] Inventor: Katsuji Kodera, 35-12, Wada 1-chome, Suginami-ku, Tokyo, Japan

[21] Appl. No.: 832,027

[22] Filed: Sep. 9, 1977

[51] Int. Cl.[2] ..... A61H 7/00

[52] U.S. Cl. ..... 128/52; 128/57

[58] Field of Search ..... 128/33, 24.3, 24.2, 128/52, 57

[56] References Cited

U.S. PATENT DOCUMENTS

| | | | |
|---|---|---|---|
| 1,129,802 | 2/1915 | Hoard | 128/57 |
| 1,214,305 | 1/1917 | Hoard | 128/57 |
| 2,230,057 | 1/1941 | Hill | 128/57 |
| 2,927,576 | 3/1960 | Sibert | 128/24.1 |

*Primary Examiner*—Lawrence W. Trapp

*Attorney, Agent, or Firm*—Wenderoth, Lind & Ponack

[57] ABSTRACT

A massaging machine provided with a back-rest frame having projections for massage, which back-rest frame is located in the front of a machine base, said base carrying a mobile frame reciprocally movable in the back and forth directions which permits a massage treatment to be carried out with variable pushing power according to the body-build of a person to be massaged.

6 Claims, 5 Drawing Figures

MASSAGING MACHINE

BACKGROUND OF THE INVENTION

The present invention concerns a massaging machine, and more particularly it concerns a massaging machine which massages such points as the back of the neck, the side of the neck, the upper shoulders and the interscapular, the back and the sacral region located on the back of a person. These areas are called the Points in a SHIATSU finger pressure massage, which points are massaged without undue pressure or stimulation.

DESCRIPTION OF THE PRIOR ART

In the conventional type of massaging machines, the human body is pressed against the hands of the machine, which machine reciprocates the lateral movement in the horizontal direction. Such machine necessarily imparts tension to such parts as the trapezins and teres major, which would result in insufficient massaging effects, and conversely the tensioned muscles would be excessively stimulated, causing various obstructions.

However, if the hands thus-moving horizontally were to be designed so as to move forward and backward, or vertically, then the design for the support device for the hands or the power transmission mechanism would necessarily be complicated which would raise the manufacturing costs.

SUMMARY OF THE INVENTION

The present invention was arrived at with a view of counteracting the aforementioned problems and aims at offering a massaging machine which is simply constructed and which performs an ideal massage without imparting undue tensions to the various critical points, as mentioned above.

DESCRIPTION OF THE DRAWINGS

The present invention will now be explained in an effort to describe one embodiment of the invention, reference being made to the attached drawings in which.

DESCRIPTION OF THE PREFERRED EMBODIMENTS

Figure 1:
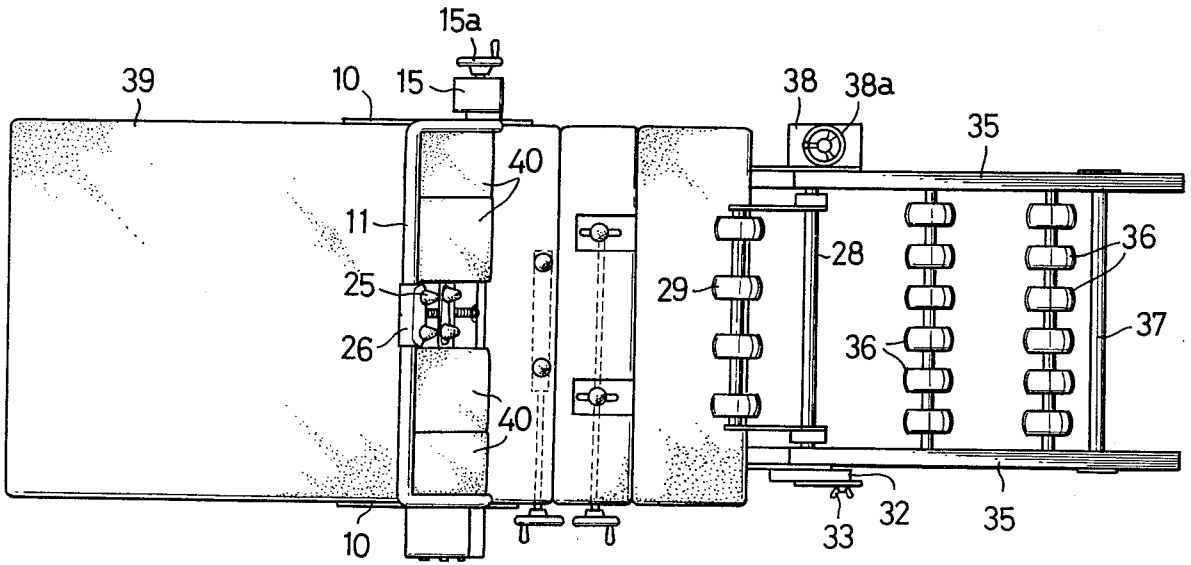
FIG. 1 is a plan view of the massaging machine in accordance with the present invention.
Figure 2:
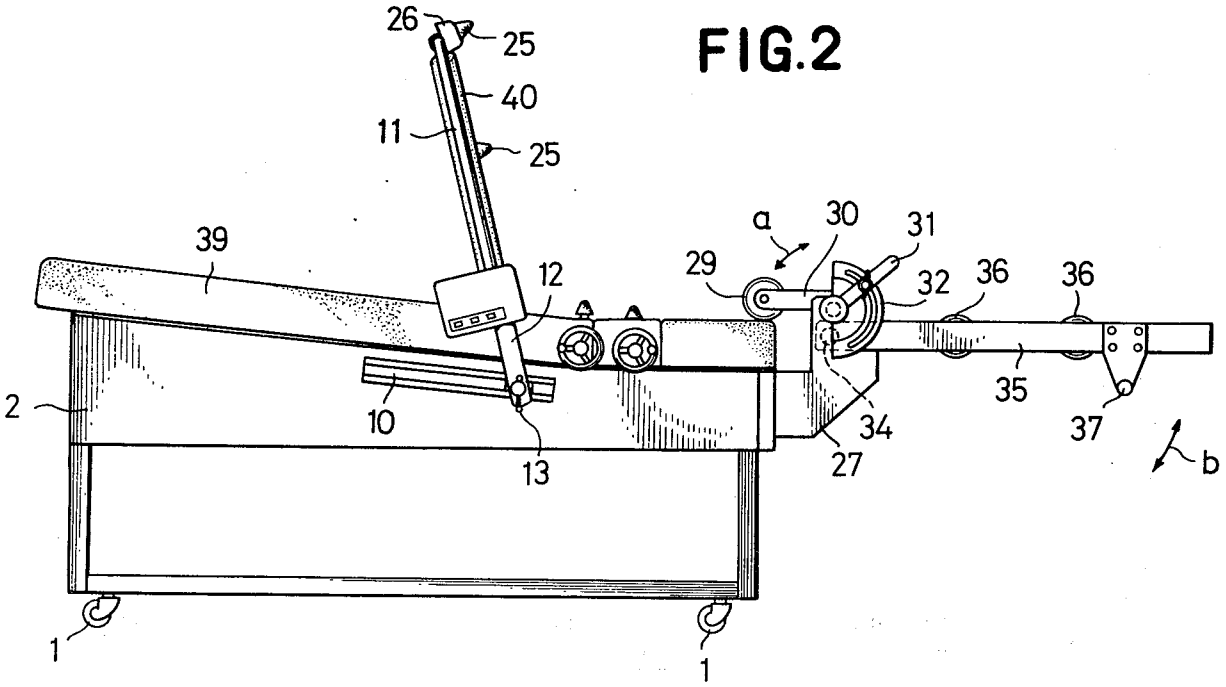
FIG. 2 is a side view thereof.
Figure 3:
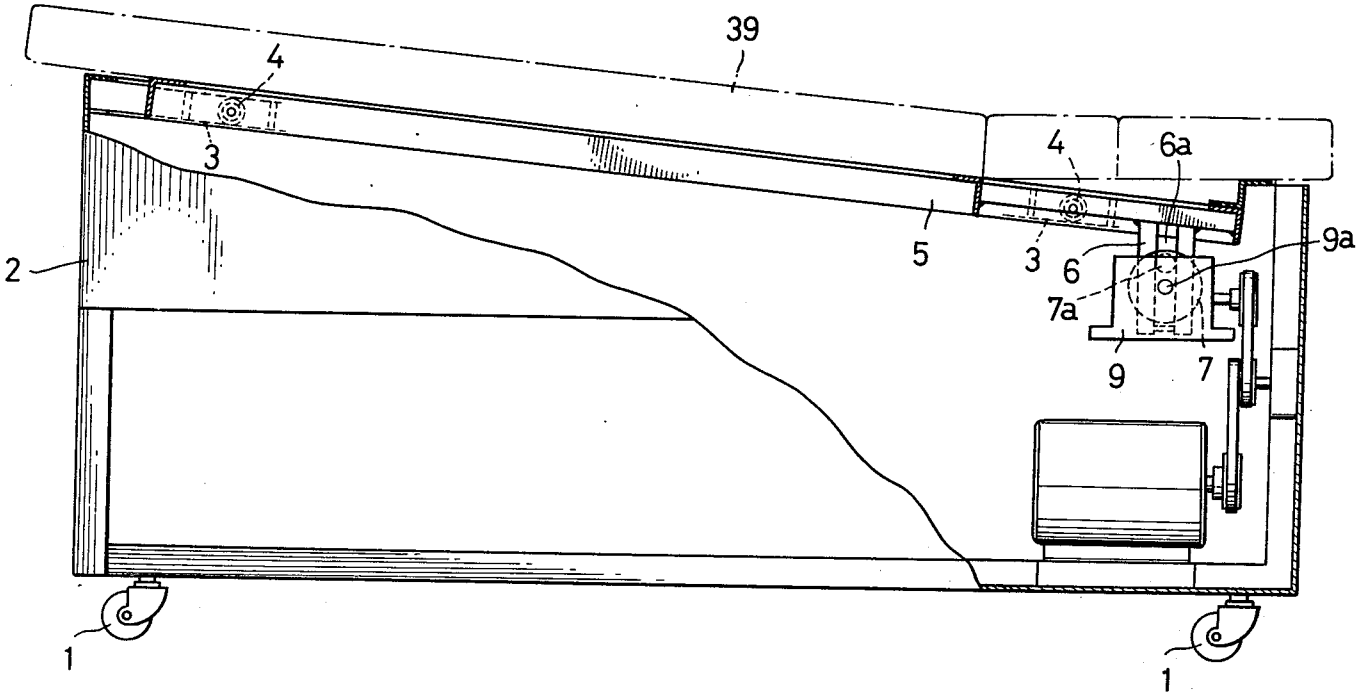
FIG. 3 is a partial fragmentary side view showing the driving mechanism.
Figures 4, 5:
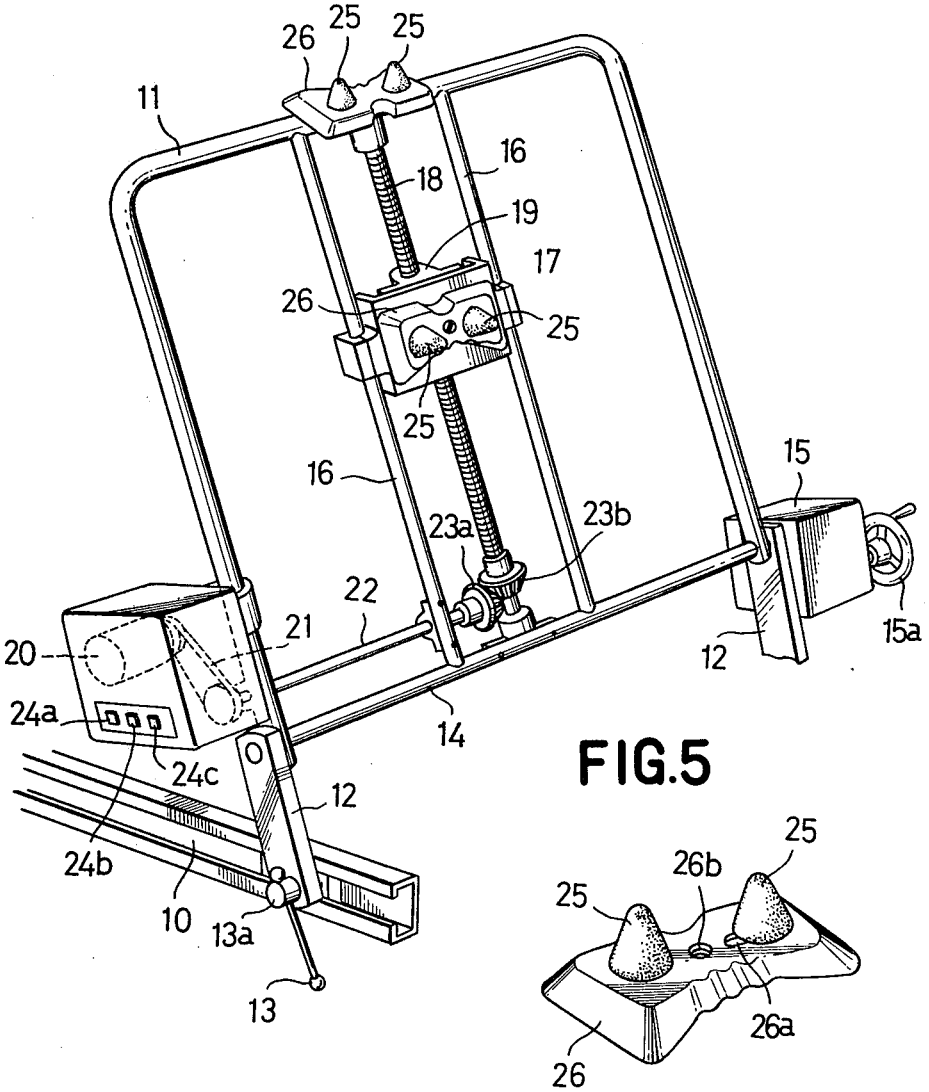
FIG. 4 is an oblique view showing the details of the back-rest.
FIG. 5 is an oblique view showing the attachment of the projections.

On the machine base 2 having casters 1 is placed a mobile frame 5 which is slidable via the guide rails 3 and rollers 4 with the channel 6*a* of a cam plate fixed at the lower front of the said mobile frame 5 by being interlocked with the pin 7*a* located on the rotating plate 7. The said rotating plate 7 is fixed to the output axis 9*a* of the gear box interlocked to the motor 8 to cause the mobile frame 5 to move forward and backward with the turning of the motor 8. Guide rails 10 fixed along the two longitudinal sides of the said machine base 2 engage and support the support rods 12 which are screwed to the lower edge of the back-rest frame 11 inclined above the said mobile frame 5. By suitably turning the lock-screw 13*a* having an operating handle 13, the back-rest frame 11 may be fixed at an arbitrary position with respect to the machine base 2 via the support rods 12.

Between the support rods 12 and the back-rest frame 11 is positioned a control device 15 for inclining and fixing the back-rest 11 with respect to its center axis 14. If a worm is joined and fixed to the handle 15*a* and a worm wheel to the center axis 14, then the back-rest frame 11 may be gradually inclined forward and/or backward by turning the handle 15*a* to determine an arbitrary angle between the back-rest frame and the mobile stand 5.

On the other hand, the guide rods 16 fixed to the center and along the vertical direction of the said back-rest frame 11 have a sliding frame 17 inserted thereinto. By connecting and fixing the nut 19 screwed through the screw rod 18, and also by connecting the lower end of the screw rod 18 with the motor 20 via the belt 21, the axis 22, the gears 23*a*, 23*b* and finally by selectively operating the switch buttons 24*a*, 24*b* and 24*c*, the motor 20 may be rotated, reversed or stopped in order to move the sliding frame vertically along the guide rods 16 or to stop the sliding frame 17 via the screw rod 18 and the nut 19.

In the front of the said sliding frame 17 and at the center of the top of the back-rest frame 11 are provided removable support plates 26 having projections 25 for massaging. In particular, the support plate 26, attached to the top of the back-rest frame 11, is rotatably attached in the front and rear directions.

The projections 25 are shaped like corns and made from such visco-elastic, comparatively hard materials as synthetic rubber, synthetic resin or from metals, and they are attached with the long holes 26*a* and 26*b* bored on the support plate 26 in such a way that the space between them may be freely widened or narrowed, i.e. they may be changed depending on the need. 26*b* is a tapped hole for changing the distance between the projections 25.

To the axis 28 screwed to the bearing plates 27 located on the front of the said machine base 2 is fixed the base of the arms 30 to which are screwed thigh-rest rollers 29. On the other end of the said axis 28 is fixed a lever 31, the said lever 31 and the engagement plate 32 joined together by a butterfly bolt 33, acting together to raise, fix and rotate the thigh rest rollers 29 freely in the direction of the arrow "a". On the other hand, the leg-rest rollers 36 are attached to the support rods 35 in such a way as to allow an interchange of its position of attachment, the said support rods 35 being fixed at their base to the other axis 34 screwed to the said bearing plates 27. Further, the connecting axis 37 is also fixed by the said support rods 35 which may be moved in the direction of the arrow "b" by the adjusting device 38 having a handle 38*a*.

Above the said mobile frame 5 are provided mobile stands 39 which have a shock-absorbing function. The back-rest frame 11 also has back-rest plates 40 which have a shock-absorbing function.

For massaging a person using the massaging machine as above constructed, the person sits on the mobile stand 39 provided on the mobile frame 5 with his thighs and legs thrust in front above rollers 29 and 36, respectively, and leans against the back-rest plate 40. Then, the motor 8 is driven so as to reciprocally move the mobile frame 5 to the front and back of the back-rest frame 11 and the person's back is rubbed against the projections 25 and also reciprocally moved vertically as if he was receiving the SHIATSU finger massage.

By moving the back-rest frame 11 horizontally to the front and back, the back-rest frame 11 may be fixed at a position most suited to the contour of the person's body. Also, by inclining the back-rest frame 11 forward and backward, the contact pressure between the projections 25 and the back, or the lean weight against the back-rest frame 11, may be changed and at the same time by adjusting the inclination, the reciprocating width between the projections 25 and the back may also be varied. In other words, if the back-rest frame 11 is raised to a nearly vertical position, then the weight against the back-rest frame 11 is very small whereas if the frame is inclined backward, the weight would naturally increase. Also, if the direction of the movement for the mobile frame 5 and the inclining direction of the back-rest frame 11 were to come closer, then the movement of the back against the inclining direction of the back-rest frame 11 may also be increased. With these interactions, it is possible to select the pressure of the massage from a very light touch to a considerable pressure by merely inclining and adjusting the back-rest frame instead of changing the width and speed of movement of the mobile frame 5.

Further, by moving the projections 25 vertically along the front of the back-rest frame 11, the points of massage may be moved and the combination of the inclination of the said back-rest frame 11 will also facilitate massage of the patient at an arbitrary position with an arbitrary pressure. By changing the angle of the thigh-rest rollers 29 and the leg-rest rollers 36, it is naturally possible to massage the thighs and legs.

As has been discussed above, the present invention facilitates massages of highly therapeutic effects as if performed manually by reciprocally moving the mobile frame against the back-rest frame provided with projections.

What is claimed is:

1. A massaging machine comprising a machine base, a mobile frame reciprocally moveable on a machine base, a back-rest frame mounted to the machine base in the manner that its mounting position may be changed and it may be inclined freely, a sliding frame mounted loosely to two guide rods extending parallel to each other in the vertical direction at the back-rest frame, a screw rod parallel to the guide rods being inserted in the sliding frame and the said frame, in turn, being transferable according to the rotation of the screw rod, and two projections for massaging located on the sliding frame arranged in the direction perpendicular to the guide rods.

2. A massaging machine according to claim 1, wherein the said mobile frame is provided with mobile stands which have a shock-absorbing function.

3. A massaging machine according to claim 1, wherein the mounting position of the said back-rest frame is changeable by support rods which can be fixed at desired positions by an operating handle on guide rails secured on both sides of the said machine base and extending in the front and rear directions; and the inclining angle of the said back-rest frame is also changeable by a control device located at the extension of a center axis provided at the lower end of the said back-rest frame.

4. A massaging machine according to claim 1, wherein a gear is mounted to the said screw rod and the said sliding frame is transferable by rotating the said screw rod by a motor provided outside the said back-rest frame through an axis of a gear which engages with the said gear.

5. A massaging machine according to claim 1, wherein the said massaging projections have pointed ends and are formed from hard rubber or plastics.

6. A massaging machine according to claim 1, wherein one of the said massaging projections is secured to a support plate, while the mounting axis of the other is inserted in a long hole provided in the said support plate so that the mounting distance of the two projections may be changed as desired.

* * * * *